US006248706B1

(12) United States Patent
Herrmann et al.

(10) Patent No.: US 6,248,706 B1
(45) **Date of Patent: *Jun. 19, 2001**

(54) ENZYME GRANULATE FOR WASHING AND CLEANING

(75) Inventors: Hubert A. Herrmann, Cremlingen-Weddel; Rolf Spannagl, Husum, both of (DE)

(73) Assignee: Genencor International, Inc., Palo Alto, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/180,181

(22) PCT Filed: May 13, 1997

(86) PCT No.: PCT/US97/07982

§ 371 Date: Mar. 31, 1999

§ 102(e) Date: Mar. 31, 1999

(87) PCT Pub. No.: WO97/43482

PCT Pub. Date: Nov. 20, 1997

(30) Foreign Application Priority Data

May 13, 1996 (DE) ..... 196 19 221

(51) Int. Cl.[7] ..... C11D 3/382

(52) U.S. Cl. ..... 510/320; 510/438; 510/462; 510/475; 510/530; 435/187; 435/188

(58) Field of Search ..... 510/438, 451, 510/462, 475, 530, 320; 435/263, 264

(56) References Cited

U.S. PATENT DOCUMENTS

| | | | | |
|---|---|---|---|---|
| 3,635,836 | * | 1/1972 | Mullen | 252/316 |
| 4,106,991 | * | 8/1978 | Markussen et al. | 195/63 |
| 4,418,147 | * | 11/1983 | Muetgeert et al. | 435/178 |
| 4,689,297 | * | 8/1987 | Good et al. | 435/174 |
| 5,318,733 | * | 6/1994 | Carduck et al. | 264/15 |
| 5,324,649 | * | 6/1994 | Arnold et al. | 435/187 |
| 5,376,288 | * | 12/1994 | Falholt et al. | 252/95 |
| 5,739,091 | * | 4/1998 | Kiesser et al. | 510/224 |
| 5,858,169 | * | 1/1999 | Raehse et al. | 159/48.1 |
| 5,879,920 | * | 3/1999 | Dale et al. | 435/187 |

* cited by examiner

*Primary Examiner*—William Krynski
*Assistant Examiner*—Dawn L. Garrett
(74) *Attorney, Agent, or Firm*—Genencor International, Inc.

(57) ABSTRACT

The preparation of an activity-stable and low-dust enzyme granulate for washing and cleaning applications, e.g. for use in granular washing and cleaning agent compositions, is described. Also described are the activity-stable and low-dust enzyme granulates obtained in accordance with the method of preparation as well as their use in washing and cleaning applications. In addition, in a special aspect of the invention, the use of specially selected flours as auxiliary agents for the preparation of enzyme granulates for diverse application purposes is described.

38 Claims, No Drawings

ENZYME GRANULATE FOR WASHING AND CLEANING

The invention concerns the preparation of an activity-stable and low-dust enzyme granulate for washing and cleaning applications, i.e., for use in granular washing and cleaning agent compositions. Additionally the invention concerns the activity-stable and low-dust enzyme granulate obtained by the method of preparation as well as their use. In a special additional aspect the enzyme concerns the use of specially selected flours entirely generally as auxiliary materials (e.g., as vehicles or fillers) for preparation of enzyme granulates for various application.

In numerous washing and cleaning agent compositions, e.g., for cleaning textiles or utensils, enzymes are used to improve the washing or cleaning efficiency. Proteases, lipases, amylases or cellulases are customarily used as enzymes; the enzymes can be used as individual enzymes or as enzyme mixtures. The enzymes are added to powdered or granular washing and cleaning agent formulations in the form of the so-called enyzme granulates, which contain the relevant enzyme or enzyme mixture together with a filler, binder and optionally other granulation auxiliary agents and formulation agents. Enzyme granulates of this kind are customarily obtained by processing an enzyme granulate with a filler and binder as well as optionally with additional granulation auxiliary agents and formulation agents into a mixture and granulating it. The resulting wet granulate particles are optionally additionally rounded and then dried. Optionally the dried granulate particles are additionally coated with a protective coating and they can then be used in powdered or granular washing and cleaning agent formulations.

In the preparation of enzyme granulates for washing and cleaning applications it is desirable to use a simple and economical method which additionally can be carried out in an enzyme-sparing manner and for ecological reasons is based as far as possible on natural granulation and formulation auxiliary agents. For example, in DE 43 10 506 a method is described which uses as natural raw materials for granulation swellable starch, cornstarch and a certain amount of cereal flour, especially wheat flour. Also in WO 94/104665 enzyme granulates are described that derive from cereal flours, especially wheat or rye flour, and additionally calcium formate and optionally lactose are added to stabilize the enzyme. The methods of the state of the art, however, produce the enzyme granulates by extrusion methods, in which the enzymes in general must stand up to severe pressure, temperature and friction loads. Because of the load undesired losses of activity frequently arise, which must be compensated by an elevated use of enzyme activity, if granulates with acceptable enzyme activities are to be made available. Additionally, it is difficult in extrusion methods to add cereal flours in amounts considerably higher than 40 wt % into the enzyme granulate, since the enzyme granulate particles that are obtained stick together after extrusion and are poorly formable in an optionally following rounding on customary rotary plate devices. In DE 27 30 481 a method for preparation of enzyme granulates using a granulation apparatus (mixer) is proposed, in which, however, a relatively large amount (up to 40 wt %) of cellulose fiber powder without binding capacity must be added to the remaining constituents in order to avoid layers of wet granulate mass that adhere to the walls in the drum granulator and that are difficult to remove and in part are quite thick. Only by the addition of said cellulose powder does one succeed, in accordance with DE 27 30 481, in carrying out the granulation, which is hard to control.

There was the task of making available a simple, enzyme-sparing and economical method of making enzyme granulates, especially for powdered or granular washing and cleaning agent compositions, as well as new enzyme granulates prepared in this way, which exhibit favorable properties with regard to activity stability, dust-forming behavior, processing and use, i.e., in powdered or granular formulations for washing, cleaning, bleaching and dishwashing compositions.

The task is resolved by the method given in Claim 1, by the activity-stable and low-dust enzyme granulates prepared by this method in accordance with Claim 21, the applications given for them in Claims 26 through 28 and the use of special raw materials given in Claim 29. Practical embodiments of the method in accordance with the invention are related in subclaims 2 through 20 and with regard to the enzyme granulate in accordance with the invention in subclaims 22 through 25.

Accordingly, a method for preparation of an activity-stable and low-dust enzyme granulate for washing and cleaning applications is made available through the invention, where the method in accordance with the invention is characterized by the fact that one first prepares a moist granulate, 0.1 to 25 parts by weight enzyme or enzyme mixture (calculated as dry substance content of the enzyme preparation that is used), 75 to 99.9 parts by weight (including moisture content) of an organic flour type with a degree of grinding of 30 to 100%, where the flour type was obtained by grinding of a flour source that had been treated with dry superheated steam that was optionally washed and/or purified beforehand,

- and where the parts by weight of the enzyme or enzyme mixture and of the flour type add up to 100 parts by weight,
- optionally up to a total maximum of 20 parts by weight customary granulation and/or formulation auxiliary agents (calculated as water-free auxiliary agents),
- using a calculated amount of water, which is sufficient to produce a moisture content of 15 to 50 wt % in the moist granulate (with respect to the total of the constituents of the moist granulate as 100 wt %),
- is formed in a high-speed mixer by intensive mixing with at least partial use of a cutter head to a nonsticking free wet granulate with particles in the particle size range of 0.2 to 2 mm,
- the moist granulate obtained in this way is, if desired, additionally further rounded before the wet granulate is additionally dried and,
- if desired, the dried enzyme granulate is separated from undersize and/or oversize granules by screening,
- and optionally the particles of the acceptable grain fraction of the enzyme granulate obtained by screening can additionally be coated with one or more protective layers. The term "nonsticking" here means that the moist granulate no longer sticks to the mixing apparatus or the wall of the mixer.

In a practical embodiment of the invention this method is characterized by the fact that 2 to 25 parts by weight of enzyme or enzyme mixture, 75 to 98 parts by weight flour type, optionally up to a maximum total of 15 parts by weight granulation and formation auxiliary agents and a calculated amount of water, which is sufficient to produce a moisture content of 15 to 40 wt %, are used for preparation of the moist granulate. Preferably 5 to 21 parts by weight enzyme or enzyme mixture, 79 to 95 parts by weight flour type, only 0 to 5 parts by weight granulation and formulation auxiliary agents and a calculated amount of water, which is sufficient to produce a moisture content of 15 to 30 wt % in the moist granulate, are used for preparation of the moist granulate.

In accordance with the invention, organic flours (thus flours of organic starting materials) of certain types are used. The term "organic flour" here encompasses, within the scope of the invention, all more or less size-reduced, powdered to fine grained products, which have been obtained by size reduction (grinding) of solid organic materials of natural origin (the flour source). It is expedient in the method according to the invention to use organic flours that are obtained by grinding of cereal grains, legumes and/or fruits of the Malvaceae family (e.g., cottonseed). The cereals that can serve as flour sources within the scope of the invention are especially wheat or rye, but barley, oats, rice and maize, as well as sorghum and other types of millet can also be used. Although buckwheat itself is not a cereal (it is a knot grass), its beechnut-like flour-yielding parts can likewise be used as flour source within the source the scope of the invention. In a preferred variation of the invention legumes serve as a flour source. Legumes here are understood to mean vegetable foodstuffs (legumes) belonging to the fruits and vegetables. The fruits of leguminous species such as Pisum (pea), Cajamus (pigeon pea), Cicer (chick pea); Lens (lentils); Phaseolus (kidney bean), Vigna (cow pea); Doichius (lablab bean); Cassavalia (sword bean), Vicia (horsebean or vetch); Peluschken [maple pea]; Arachis (peanut); lupins; lucerne; soybeans as well as lima beans and, if applicable, other legumes and other Malvaceae fruits (e.g., of the genus Gossipium, cotton) may be considered as flour sources within the scope of the invention. Especially preferred are peas and in particular soybeans. Within the scope of the invention it was found here for the first time that leguminous flours or flours from fruits of the Malvaceae family are entirely generally especially advantageously suitable as auxiliary materials for the preparation of enzyme granulates, since when they are used as vehicles or fillers or also when they are used as additional formulation constituents in addition to other customary vehicles and fillers, they have a positive effect on the enzyme stability both of the individual enzymes and enzyme mixtures as well as the dust properties of the enzyme granulates thus produced; in addition, these flours allow a preparation of enzyme granulates that is simpler, more enzyme-sparing and more economical compared to other customary vehicles or fillers, not only for washing and cleaning applications, but also for many other industrial fields of use. The invention thus also quite generally concerns the use of leguminous flours or flours of fruits of the Malvaceae family for preparation of enzyme granulates for any applications, especially here, however, for preparation of enzyme granulates for washing and cleaning applications in household use, in commercial and/or industrial use.

Of the oil-containing fruits [beans] of these examples both defatted and partially defatted as well as oil-containing fruits can be used to make the flour that is used in accordance with the invention; for these purposes partially to completely defatted fruits are preferred, especially partially to completely defatted legumes, e.g., to a large extent defatted soybeans. The defatting can here take place in substantially known ways.

The flours used within the scope of the invention are, in each case according to the grinding methods that are used and the degree of grinding that is attained in each case, fine powders of yellowish-white to dark gray color (light or dark flours) or optionally more or less granular (whole meal, semolina, fine semolina) or white-yellowish brown mixed products. The organic flour types usually exhibit a moisture content up to about 15 wt % (e.g., moisture content of 7 to 15 wt %), which should be taken into consideration in calculating the percentage moisture content of the moist granulate prepared in accordance with the invention in a high-speed mixer. Customarily those cereal flours are used in the invention that have a moisture content of about 10 to 15 wt %, especially 13 to 15 wt %. In the case of the preferred leguminous or also Malvaceae flours, these have a moisture content of about 7 to 11 wt %.

Other important criteria for characterization of the flour type used in accordance with the invention are the degree of grinding and the so-called flour type; these criteria correlate with each other so much that the index of the flour type also increases with an increasing degree of grinding (i.e., the degree of size reduction or the fineness of the flour). The degree of grinding corresponds to the amount by weight of flour obtained with respect to 100 parts by weight of the flour material that is used (within the scope of the invention, therefore the cereal or the legumes or Malvaceae fruit that is used); it is therefore a percent flour yield. In grinding the flour mainly clean, very fine flour accumulates at first, e.g., from the heart of the cereal grain, and with further grinding, therefore, e.g., with increasing degree of grinding, the proportion of crude fiber and hull in the flour increases; the starch content then will be lower. The degree of grinding is also reflected in the so-called "flour type," which is used as a numerical value for classification of flours, especially cereal flours, and which is based on the ash content of the flour (the so-called ash scale). The flour type or the type number in this connection gives the amount of ash (mineral materials) in mg that remain behind when 100 g dry flour substance is burned. On the example of cereal flours the type number can be illustrated as follows: the higher the type number, the darker the flour will be and the higher the degree of grinding will be, since the kernel of the cereal grain contains only about 0.4 wt % ash while the hull contains something around 5 wt % ash. A white flour of type 405 thus contains, e.g., an average of 0.405 wt % ash. For a lower degree of grinding the cereal flour in contrast consists predominantly of the size-reduced flour particles, i.e., the starch constituent of the cereal grains; at a higher degree of grinding the cereal flours also contain the size-reduced, protein-containing aleuronic layer of the cereal grains, in the case of whole flour it also contains the constituents of the protein-and fat-containing germ, as well as the crude fiber- and ash-containing seed hulls.

The degree of grinding of the flour used in the course of the invention is 30 to 100%. A degree of grinding of 30% corresponds to a very fine flour, while a degree of grinding of 100% corresponds to a whole grain flour. In practical variations of the method in accordance with the invention, the invention is distinguished by the fact that the degree of grinding of the flour type amounts to 50 to 100%, preferably 70 to 100%. Within the scope of the invention leguminous fine flour, e.g., pea or especially soy fine flour, is preferably used.

The flour used in the method in accordance with the invention is distinguished by the fact that it was obtained from a flour source which before grinding was subjected to a treatment with dry superheated steam with a temperature of especially 100 to about 110° C. at nearly normal pressure to low overpressure (e.g., 0.8 to 1.2 bar overpressure) and a treatment time (residence time in the superheated steam treatment apparatus described below) of up to about 1 hour. Dry superheated steam is a superheated and unsaturated steam, which can be obtained in the conventional way by superheating and removal of possible water condensate or by expansion of steam from high pressure. The superheated steam treatment of the flour source can, e.g., take place while using a conical hopper that becomes wider toward the bottom, which is a equipped with one or more ring nozzles for steam lances for introduction of the dry superheated steam. The hopper can intermittently or continuously be supplied with the flour source, e.g., through screw conveyors and evacuated through heated screw conveyors. The superheated steam-treated flour source will then, e.g., in a connected fluidized bed dryer, be conditioned to a constant water content of a maximum of 15 wt % and cooled in an additional fluidized bed dryer for the subsequent grinding. The treated and cooled flour source is then continuously fed to a grinding machine and ground to a particle size distribution with the primary proportion of particle sizes in the range of 500 to 5 $\mu$m; preferably the proportion of particles with a particle size of 300 to 500 $\mu$m does not exceed 10 wt %.

The mixing and granulation of the constituents can take place in the method in accordance with the invention in a batch operating high-speed mixer, e.g., of the plowshare mixer type, or in a continuous high-speed mixer, e.g., of the Schugi Flexomix type (Schugi Process Engineers, Lelystadt, Netherlands). Nonsticking moist granulate is obtained, in which water is dispensed, optionally via an enzyme solution or with a possibly added granulation or formulation or auxiliary element, continuously in dependence on the feed of the solid primary constituents so that the moisture content in the moist granulate (thus before drying) at the mixer outlet is in general 15 to 50 wt %, preferably 15 to 40 wt %, and especially 15 to 30 wt %. The solid constituents for the granulate composition can if desired be premixed in the mixer up to about 5 to 10 minutes before the aqueous granulation liquid (e.g., water, enzyme solution or aqeuous solution of constituents for the granulate) is mixed in and granulated; at the end of the granulation time the cutter head of the mixing apparatus is switched on for a few more minutes. According to the method in accordance with the invention, a moist granulate with a particle size range of 200 to 2000 $\mu$m, preferably 200 to 1000 $\mu$m will thus be obtained. The mixing time in the high-speed mixer or in the continuous method the average residence time will be in the method in accordance with the invention as a rule up to a maximum of about 30 minutes; here the specialist can adjust the mixing time or the residence time, which includes the necessary time for the introduction of the granulation liquid and the mixing and the cutter head treatment, to the desired properties of the moist granulate (e.g., freedom from stickiness, particles sizes) or to the mixer. Time periods up to about 25 minutes, especially from 3 to 8 minutes, are sufficient as expedient mixing or residence times, especially in batchwise processing; in continuous processing shorter average residence times in the mixer can be sufficient according to the type of high-speed mixer. If desired, to improve the granulate size they can be postmixed additionally up to several minutes using the cutter head. Then for rounding of the granulate particles the moist granulate can be formed in a rounding apparatus, preferably in a rotary table apparatus or a so-called Marumerizer® by postrolling for a time of 0.5 to 10 minutes, preferably 0.5 to 5 minutes. After granulation the moist granulate is subjected to a conventional, enzyme-sparing drying, e.g., in a fluidized bed [Fliessbett] or a fluidized bed [Wirbelschicht] and dried to a granulate with a desired moisture content, especially a moisture content of 3 to 12 wt %, preferably 8 to 10 wt %. The dried granulate can, if desired be separated from oversize and undersize particles by screening, and the particles separated from the acceptable particle fraction can be ground and recycled to the granulation method. Fine dust portions that may arise can here by removed by screening, e.g., on an air jet classifier; the screening optionally can take place only after coating of the granulate particles with a protective coating or, if desired, can be repeated.

In a particular embodiment of the method in accordance with the invention the powdered, optionally premixed constituents for the enzyme granulate can be fed batchwise or continuously to the high-speed mixer and then likewise partially or continuously a suitable amount of water for adjustment of the moisture content or a suitable amount of an aqueous solution, optionally with the granulation and/or formulation auxiliary agents dissolved therein or the enzyme or enzyme mixture dissolved therein, can be dispensed to the mixer and after the given residence time the moist enzyme granulate is removed or continuously withdrawn from the high-speed mixer. An expedient mode of action in this variation of the method is distinguished, e.g., by the fact that of the constituents for the enzyme granulate only the flour type in powdered form is fed batchwise or continuously to the high-speed mixer and then likewise batchwise or continuously an aqueous enzyme solution with a content of enzyme or enzyme mixture determined according to the amount of flour and an amount of water suitable for adjustment of the moisture content are dispensed to the mixer.

After drying the enzyme granulate can additionally be coated in a customary way with a varnish or film or other protective coating. The coating or varnish can contain an additional enzyme or, alternatively can serve to color the granulate or for protection of the enzyme, or also can cause retardation of the release of the enzyme or enzyme mixture. Here the varnish or the coating can be applied both continuously or batchwise to the enzyme granulate. In the method in accordance with the invention, if one or more protective layers are optionally applied to the granulate particles of the prepared enzyme granulate, then the amount of protective layer constituents (as dry substance) can as a rule amount to 5 to 26 wt % with respect to the particles of the uncoated enzyme granulate. The customary varnishes or coatings for enzyme granulates can be applied as the protective layer, i.e., the customary organic polymers, with or without additional pigments. An expedient protective layer or coating is distinguished, e.g., by the fact that 100 parts by weight of the protective layer are made up of the constituents 40 to 60 parts by weight, preferably 45 to 55 parts by weight pigments, especially white pigments titanium dioxide and/or calcium carbonate, and 60 to 40 parts by weight, preferably 55 to 45 parts by weight varnish binder selected from water soluble polymers, especially polyethylene glycol with molecular weights in the range of 1500 to 10,000, from polyvinyl alcohols or polyvinyl alcohol copolymers with molecular weight characteristics in the range of K 70 to K 110, polyacrylic acids, polymethacrylic acids and/or cellulose ethers.

In the method in accordance with the invention substantially all enzymes can be used that are common for washing and cleaning agent compositions. The enzyme can in this case be an isolated, pure enzyme (i.e., without side activities) or a mixture of enzymes. An enzyme mixture can be composed of pure enzymes without side activities or can be obtained in a simple way equally in the form of a process-dependent enzyme mixture obtained in the production of enzymes from microorganisms; such process-dependent enzyme mixtures obtained in dependence on microorganism include as a rule, besides a main enzyme, various accompanying enzymes (the so-called side activities), which optionally display a favorable synergistic side effect. The enzyme or enzyme mixture can thus in general be a hydrolase, oxidase or reductase or a mixture thereof. Preferred hydrolases are carbohydrases, proteases, lipases, esterases. The carbohydrases for the method in accordance with the invention are, e.g., selected from cellulases, xylanases, pentosanases and amylases. If oxidases are used, they can be glucose oxidases or peroxidases; other very practical enzymes within the scope of the invention are catalase (desizing of textiles), lysozyme, muramidase. Within the scope of the invention other enzymes can also optionally be used, e.g., β-glucanases, pectinases, arabanases, hemicellulases, galactomannanases, polygalacturonases, glucoamyases, β-galactosidases, pullulanases, Driselase® and others. The proportion (the amount) of enzyme that is used in this connection is dependent on the individual specific enzyme activity and the desired activity in the prepared enzyme granulate. For example, pentosanase has as a rule a high specific activity and can, in amounts up to 0.1 parts by weight, assure a sufficient enzyme activity in the prepared enzyme granulate. In general, bacteria, especially from the genus Pseudomonas or Bacillus (e.g., *B. subtilis, B. lichenifonnis, B. alkalophilus, B. lentus, B. amyloliquefaciens* and others) or fungi, especially from the genus Aspergillus, Trichoderma, Rhizopus, Penicillium, Irpex can be used for preparation of the enzyme or enzyme mixtures; other sources for appropriate enzymes within the scope of this invention are, e.g., Ascomycetes, Streptomycetes, Humicola, Micrococcus and, e.g., bromelias and papaya plants for enzymes of plant and pancreas for enzymes of animal origin should be named. It is also possible, if desired, to clone the structural gene of the enzyme in appropriate strains of microorganisms and to express it. Here any microorganism is appropriate that assimilates the DNA for the enzyme to be cloned plasmidically (episomally) or genomically (chromosomally) and that can perform the corresponding functions. Enzymes that have been modified by gene engineering, e.g., especially site directed mutated or optimized enzymes, can also be used within the scope of the invention.

The enzyme or enzyme mixture used in the method in accordance with the invention can be used in the form of a powder or an aqueous solution of the enzyme or enzyme mixture. Practical enzymes or enzyme mixtures are in this connection enzyme preparations such as customarily arise in industrial preparation methods. Such enzyme preparations contain as a rule not only a single enzyme or a mixture of enzymes, but also subordinate amounts of other accompanying substances that are dependent on the preparation method. Examples of such accompanying substances are, e.g., salts, which are added for precipitation or crystallization of the enzyme from an enzyme concentrate, such as is obtained after separation of the biomass from a fermentation broth, or accompanying substances that are already contained in the enzyme concentrates such as proteins, peptides, amino acids, and, e.g., monomeric, dimeric, trimeric, oligo- and polymeric saccharides; the accompanying substances that are added or that are already in the enzyme concentrate could be enclosed in the precipitation or crystallization partially by the enzyme precipitate. The enzymes or enzyme mixtures could contain additionally customary enzyme stabilizers and customary suspension agents or preservatives as additional accompanying substances. Examples of such accompanying substances are sodium benzoate, calcium salts, nonreducing mono-, di- and trisaccharides, parabens, potassium and sodium sorbate, common salt. If aqueous solutions of the enzyme or enzyme mixture are used, these can be prepared by subsequent dissolving of the enzyme or enzyme mixture-powder; or in another variation the enzyme concentrates such as are obtained after separation of the biomass from the fermentation solution, optionally after being concentrated or diluted, can be used directly. Such aqueous solutions of the enzymes or enzyme mixtures also contain as a rule a certain portion of preparation method-dependent accompanying substances in addition to the true enzyme activity or in addition to the actual enzyme activities in the case of enzyme mixtures. Enzyme mixtures can, on the one hand, be obtained, e.g., directly by fermentation, where the enzymes, which in each case are then customarily formed via the microorganism that is used, must be mixed with each other in natural ratios. On the other hand, however, enzymes can also be prepared by simple mixing of commercially available individual enzymes. It is also possible to prepare modified or optimized enzymes by gene engineering, e.g., by mutation, and to use them within the scope of the invention.

In a preferred embodiment the enzyme granulates in accordance with the invention contain a cellulase, lipase, catalase, oxidase, peroxidase, thermostable α-amylase or a protease, especially an alkaline and highly alkaline protease. Proteases that have improved qualities such as elevated washing performance or improved stability because of chemical and/or gene engineered modifications can in particular be incorporated advantageously. In this connection the so-called subtilisins are especially advantageous as alkali and highly alkaline proteases. Subtilisins are proteases with a pH optimum in the alkaline pH range and an essential serine residue in the active center. They can be obtained in a substantially known way from gram-positive bacteria or fungi. The subtilisins that are obtained from bacillus strains are preferred in this case, for example subtilisins such as subtilisin BPN', subtilisin Carlsberg and subtilisins that can be isolated from *Bacillus subtilis, Bacillus amyloliquefaciens, Bacillus licheniformis, Bacillus lentus, Bacillus mesentericus* or *Bacillus alcalophilus*. Especially preferred are subtilisins that have a pH optimum in the range of 7 to 13 and that are commercially available, e.g., as Savinase®, Maxacal®, Durazym®, Maxapem® or Opticlean®.

The enzymes that are suitable for the enzyme granulates in accordance with the invention can be obtained in substantially known ways by fermentation processes from suitable microorganisms, especially from bacteria or fungi. The fermenter broths obtained in fermentation are separated from insoluble accompanying substances, e.g., by filtration or microfiltration and then concentrated in substantially known ways, e.g., by a membrane filtration method or ultrafiltration with optionally subsequent dialysis and/or by removal of the water by evaporation. In this way one obtains the so-called enzyme concentrates, which customarily contain the enzyme or enzyme mixture in an amount of 2 to 50 wt %, with respect to dry substance, in addition to possibly other unseparated accompanying substances. If desired these liquid enzyme concentrates can still additionally be converted to dry enzyme concentrates, for example, by spray drying and/or freeze drying.

According to the method in accordance with the invention an enzyme granulate can preferably be prepared whose granulate cores essentially consist only of the described organic flour type as vehicle and the enzyme or enzyme mixture as active component. Granulation and formulation auxiliary agents are not necessary here for carrying out the method in accordance with the invention. To adjust the granulate properties to the special application purpose in each case those granulation and auxiliary materials can if desired be added in an amount up to maximum of 20 wt %, expediently to a maximum of 15 wt %, with respect to the prepared moist granulate. Granulation and formulation auxiliary agents are preferably used only in an amount from 0 to 5 wt %. In the method in accordance with the invention the customary enzyme, compatible binders, fillers, suspension agents, crosslinking agents, mediators (to improve bleaching action) and/or organic solvents as well as optionally enzyme stabilizers and/or reversible enzyme inhibitors can be used as granulation and formulation auxiliary agents. Examples of customary water-insoluble fillers are in particular cellulose, laminar silicates, such as e.g., kaolin and bentonite, and/or starches. Customary water-soluble fillers are, for example, alkali chloride, alkali acetate, alkali sulfate, calcium carbonate, calcium sulfate, magnesium sulfate, sugar such as e.g., sucrose, lactose, maltose and other disaccharides, trisaccharides or polysaccharides such as dextrins.

Other customary granulation and formulation auxiliary agents are binders or binder mixtures. Expedient binders are in particular degraded soluble starch and/or wheat gluten. Other expedient binders are polyethylene glycol with molecular weights in the range of 200 to 10,000, polyvinylpyrrolidone with molecular weights in the range from 12,000 to 3 million, preferably from 1,300,000 to 2,800,000; polyvinyl alcohol or copolymers, e.g., polyvinyl alcohol copolymers with molecular weight indices in the range from K 70 to K 110. These binders can be provided both individually and in combination with one another. The enzyme granulate prepared in accordance with the invention can optionally also contain a crosslinking agent as an additional granulation and formulation auxiliary agent. Substantially customary enzyme-compatible surfactants are to be considered as crosslinking agents, e.g., ethoxylated alcohols, especially ones with 10 to 80 ethoxy groups. Enzyme stabilizers are, e.g., borates, borax, formates, di-and tricarboxylic acids. Reversible enzyme inhibitors are, e.g., organic compounds with sulfhydryl groups or alkylated or arylated boric acids.

Within the scope of the invention the substantially customary granulation and formulation auxiliary agents of the type listed above can be used. A preferred embodiment of the invention is, however, distinguished by the fact that granulation auxiliary agents such as binders, fillers, suspension agents, crosslinking agents or organic solvents are not used. Accordingly, in this variation of the invention the moist granulate is formed only from an enzyme or enzyme mixture, the flour type and, optionally as formulation auxiliary agents, enzyme stabilizers and/or reversible enzyme inhibitors while using the calculated amount of water to adjust the moisture content without using additional granulation auxiliary agents. It is also preferred not to use enzyme stabilizers and reversible enzyme inhibitors and to form the moist granulate in this case only from the enzyme or enzyme mixture and the flour type while using the calculated amount of water to adjust the moisture content, thus without the use of granulation and formulation auxiliary agents.

The invention also concerns the enzyme granulates prepared by the method in accordance with the invention, which are specially suited for use in washing and cleaning applications. Such enzyme granulates in accordance with with the invention are especially further characterized by the fact that they consist of a granulate core with the composition 0.08 to 26.4 wt % (dry substance) enzyme or enzyme mixture, 96.92 to 43.8 wt % (dry substance without moisture) of a flour type with a degree of grinding of 30 to 100%, where the flour type was obtained by grinding of a flour source that was optionally washed and/or purified beforehand, and that was treated with dry superheated steam, optionally up to a total maximum of 17.8 wt % customary granulation or formulation agents (calculated as water-free substance), and 3 to 12 wt % moisture, where the sum of the constituents of the granulate core (thus the enzyme or enzyme mixture, flour—dry substance, water and optionally granulation and formulation auxiliary agents) amounts to 100 wt %, and optionally from one or more protective layers encasing the granulate core.

Expedient enzyme granulates in accordance with the invention consist of a granulate core without other granulation and formulation auxiliary agents with the composition 0.09 to 26 wt % (dry substance) enzyme or enzyme mixture, 96.91 to 62 wt % (dry substance without moisture) of a flour type with a degree of grinding of 30 to 100%, where the flour type was obtained by grinding of a flour source that had been treated with dry superheated steam, 3 to 12 wt %, preferably 8 to 10 wt %, moisture, where the sum of the constituents of the granulate core is 100 wt %, and optionally of one or more protective layers encasing the granulate core.

If the above enzyme granulates in accordance with the enzyme have one or more protective layers that encase the granulate core, then the amount of the protective layer constituent (as dry substance) is 5 to 26 wt % with respect to the uncoated granulate core. The substantially customary varnishes or coatings for enzyme granulates can be applied as protective layer, e.g., the customary organic polymers, with or also without additional pigments. An expedient protective layer (100 parts by weight) is, e.g., composed of the constituents 40 to 60 parts by weight, preferably 45 to 55 parts by weight pigment, especially white pigment titanium dioxide and/or calcium carbonate, 60 to 40 parts by weight, preferably 55 to 45 parts by weight of a binder selected from water-soluble polymers, especially polyethylene glycol with molecular weights in the range of 1500 to 10,000, polyvinyl alcohols or polyvinyl alcohol copolymers with molecular weight indices in the range from K 70 to K 110, from polyacrylic acids, polymethacrylic acid and/or cellulose ethers.

The invention additionally concerns the use of the enzyme granulates in accordance with the invention, e.g., in powdered or granular washing and cleaning agent compositions or in general the use of these granulates in washing and cleaning applications in the household and in industry or commerce. The enzyme granulates thus can be used in powdered or granular household washing or household cleaning agent compositions of diverse kind or, e.g., especially in dishwashing compositions. In industrial or commercial use the enzyme granulates for industrial or commercial washing or cleaning applications, such as, especially for decoating or for preparation of textiles or fabrics for subsequent processing, dyeing or other treatments are within the scope of the processing of textiles or fabrics.

Through the invention a simple economical method is made available which avoids the disadvantages of the methods used in the state of the art, e.g., extrusion methods or structural varnishing on seed cores of sugar or salts. The method in accordance with the the invention is an extremely economical method of preparation for high value enzyme granulates. Thus, for example, premixtures for the preparation can be formulated extremely simply, and the method is then, e.g., equally insensitive to variations of the amount, the dry substance composition and the quality of the enzyme preparation or concentrate. Through the method in accordance with the invention it is possible to use a high proportion of natural products, e.g., flours of the type given as the granulate basis, which are ecologically more advantageous than synthetic materials. Other granulation and formulation auxiliary agents as well as separate enzyme stabilizers can thus be done away with as far as possible. Through the method in accordance with the invention, advantageous, activity-stable and low dust to dust-free enzyme granulates for washing and cleaning applications in the household, e.g., in powder or granular compositions, and in industry or commerce are made available. The enzyme granulate made available in accordance with the invention exhibits various advantages regarding further processing, i.e., regarding incorporation into washing and cleaning agent compositions. For one thing the enzyme granulate in accordance with the invention exhibits an extraordinary storage stability and release solubility of the enzyme as well as unaltered washing power in washing and cleaning compositions. The enzyme can thus optionally be also incorporated into the particles of a washing and cleaning agent granulate within the scope of the customary compaction methods without considerable losses of activity that occur because of pressure and friction loads in the preparation of pressed particles. Through the enzyme granulate in accordance with the invention the enzymes are thus placed in a form for disposal that ensures that the enzymes withstand the high load that may arise in a compaction operation.

Besides the good ability to cope with load (thermal, pressure and friction stability) the enzyme granulate in accordance with the invention has a number of other favorable properties. Thus, the enzyme granulate in accordance with the invention shows good storage stability and exhibits an especially and at most negligible extraordinarily low bacterial load. The excellent storage stability appears, e.g., in the fact that the half-life in customary test methods is slightly more than twice that of the products on the market; for example, the half-life of the enzyme granulates on the market in customary washing agent basis is 1.3 to 1.8 days in a quick test, while the values for the granulates in accordance with the invention are increased to about 4 to 5 days. In the test methods for determination of dust that are customary in the washing agent industry, e.g., no tendency toward dust formation is observed. The enzyme granulates in accordance with the invention also show outstanding washing power after storage in washing and cleaning agent formulations. The enzyme therefore is favorably stabilized in the granulate in accordance with the invention, so that it does not have a tendency to react with accompanying constituents from the enzyme concentrate used for preparation or constituents of the recipe. The enzyme granulate in accordance with the invention additionally has an advantageous particle size setting to which especially a favorable ability to be mixed and incorported in the constituents of washing and cleaning agent granulates is ensured; the enzyme granulate particles in accordance with the invention do not have any tendency toward demixing, and for this reason can readily be mixed with other washing and cleaning agent constituents and incorporated (dispersed) in washing and cleaning agent granulates. They are free-flowing, and for this reason have good bulk flow properties and dispensability. On top of that they do not show any tendency to cake according to the customary test methods in the washing agent industry.

EXAMPLES

The following examples should more closely illustrate this invention without, however, limiting it in its scope.

Example 1

Flour production (superheated steam treatment and grinding)

The superheated steam treatment of the flour sources (all cereal grains or legumes or Malvaceae fruits) takes place in a sterilization plant with the following structure:

- steam heated preheater screw, conveyor temperature about 40 to 50° C.;
- heat insulated and continuously operated steamer (vertical, conical cylinder with height 5 m; diameter at top about 40 cm, at bottom about 60 cm; temperature about 100 to 110° C.);
- three steam ring nozzles in the upper area of the steamer and three vertically arranged steam lances in the lower area;
- steam heated discharge screw conveyor;
- a subsequently connected fluidized bed dryer and a fluidized bed cooler connected after it.

The cereal or leguminous or Malvaceae grains (optionally after first being partially or completely defatted) were continuously transported to the conical steamer with the aid of the steam heated preheating screw conveyor. There, via the three ring nozzles and three steam lances, treatment with dry superheated steam (overpressure reduced from 8 bar to 0.8 bar), took place. The material temperature in the steamer was about 100° C., and the residence was a time of about 40 minutes. The withdrawal of the treated cereal or leguminous or Malvaceae grains took place via a steam heated screw conveyor, through which the treated material was carried to a fluidized bed dryer in order to remove steam and optionally condensate formed during the treatment. After cooling in a subsequent fluidized bed cooler there followed grinding of the treated cereal or the leguminous or Malvaceae grain in the substantially classical way to the desired degree of grinding.

The flour obtained after the superheated steam treatment exhibited the following average properties:

moisture content about 9 wt % (±2 wt %);

The flours treated with superheated steam in accordance with the invention thus exhibited an outstanding microbiological purity. This high microbiological purity was obtained also at high degrees of grinding (higher share of hull in flour). The flours treated in accordance with the invention were outstandingly suitable for the subsequent granulation of washing agent enzymes under mild conditions.

Example 2

Preparation of enzyme granulates in accordance with the invention

For preparation of enzyme granulates in accordance with the invention for washing agent granulates enzyme preparation and cereal and/or leguminous or Malvaceae flours obtained in accordance with Example 1 were prepared by agglomeration of a powdered starting mixture with the addition of granulation liquid. The powdered starting mixture of cereal or leguminous or Malvaceae flour was vigorously mixed in a batchwise operating plowshare mixer/agglomerator (Lodige mixer with cutter head) while spraying in an enzyme-containing aqueous granulation liquid, and the resulting granulate was then dried in a batch operating fluidized bed dryer. Undersize grain (<200 μm) and oversize grain (especially >1000 μm) were screened out and ground. The offsized grain was completely recycled to the granulation method.

The aqueous liquid that was used—the enzyme concentrate—was put together as follows from the listed constituents:

a) Enzyme concentrate of a highly alkaline protease of subtilisin type 309:
   13 wt % enzyme protein, 26.8 wt % inactive protein plus residual sugar and other accompanying and characteristic substances, with the rest being water to 100 wt %;
   activity 1,984,000 DU/g, total dry substance content 39 to 39.8 wt %.

b) Enzyme concentrate of a thermostable a-amylase (of the type Optitherm®, Solvay Enzymes GmbH & Co. KG, Nienburg, Germany; source strain *Bacillus licheniformis):*
   18 wt % enzyme protein, 21.6 wt % inactive protein plus residual sugar and other accompanying and characteristic substances, with the remainder being water to 100 wt %;

activity 1,023,000 MWU/g, total dry substance content 39.6 wt %.

In this example pea fine flour or soy fine flour with a degree of grinding of 90% was used as the flour. The specification of the particle size distribution of the pea or soy fine flour that was used (measured with the aid of a laboratory air jet classifier Alpine A 200 LS) exhibited a very narrow particle size distribution under 150 μm with very fine quality:

pea fine flour: 64 wt % <36 μm soy fine flour: 49 wt % <36 μm

The soy flour was completely defatted; the flours had a moisture content of 9.4wt %.

The powdered starting mixture of flour used in the granulation method was granulated with an aqueous spray solution of enzyme concentrate containing a highly alkaline protease of Subtilisin 309 type or a thermostable α-amylase. A 5-L Lodige mixer with cutter head, a peristaltic pump (without nozzles) and a fluidized bed dryer were used as equipment. A standard varnish of the following composition was applied to the granulate particles in an amount of 23 wt % with respect to the uncoated granulate (spraying in a fluidized bed):

50 wt % titanium dioxide, 25 wt % calcium carbonate, 22.5 wt % polyethylene glycol 4000; 2.5 wt % polyethylene glycol 200.

The individual exemplary method conditions of the tests that were carried out can be found from the subsequent tables, as well as the product qualities of the enzyme granulates obtained in these examples in accordance with the invention.

In each case well rounded enzyme granulates (without the formation of agglomerates by caking together or lumping of the granulate particles) with outstanding microbiological quality meeting specifications with regard to particle size distribution and activity and with very good technological granulate properties were prepared in each case. The dust values measured in subsequent tests using the E test (elutriation test) could if desired be considerably improved by screening on an air jet classifier (e.g., from the Alpine company with 200 μm, 300 μm and 400 μm screens), i.e., the dust value could be lowered. The measured Heubach enzyme dust values remain in this case at the very low level that was found, i.e., in the case of coated enzyme granulates about 0.12 mg/20 g of the detection limit.

Experiment 2.1. Granulation of highly alkaline protease with pea fine flour.

| Recipe | | |
|---|---|---|
| Vehicle material | Pea fine flour | 7.0 kg |
| Enzyme concentrate = granulation liquid | Highly alkaline protease of Subtilisin 309 type;<br>Aqueous liquid concentrate<br>Activity 1,984,000 DU/g<br>Dry substance content 39.8 wt % | 2706 kg |

| Conduct of experiment and time | | |
|---|---|---|
| Mixing of vehicle | Without cutter head | 1 min |
| Granulation | With cutter head<br>Spraying-in of concentrate | 9 min |
| Postmixing after exposure of dead space | With cutter head | 0.5 min |
| Drying | Inlet air temperature<br>Product temperature | 80° C.<br>40° C. |

Product qualities

| Experiment No. | 2.1a | 2.1b | Comparison |
|---|---|---|---|
| Granulate | Base granulate (uncoated) | Base granulate (uncoated) 23 wt % standard coating | Base granulate (uncoated) by extrusion method with the same enzyme concentrate |
| Bulk weight | 9.2 wt % | about 730 g/L | |
| Moisture content | 820,000 DU/g | 720,400 DU/g | 860,000 DU/g |
| Activity | | 48 mg/20 g | 99 mg/20 g |
| Heubach total dust | 123 mg/20 g | | |
| Heubach enzyme dust | | 2.0 mg/20 g | 80 mg/20 g |
| E-test | 7.5 mg/20 g | 200 DU/60 g | |
| Solubility 1 min | 31,000 DU/60 g | 86% | |
| Solubility 2 min | 54% | 94% | |
| Solubility 3 min | 68% | 95% | |
| Solubility 5 min | 92% | 100% | |
| Solubility 8 min | 99% | | |
| Acceptable granules 200–1000 μm | 100% | | |
| Oversize granules >1000 μm | | 100 wt % | 100 wt % |
| Undersize granules <200 μm | 64 wt % | 0 wt % | 0 wt % |
| Washing power: delta reflectance starting | 18 wt % | | |
| Washing power: delta reflectance, 7 days | | 0 wt % | 0 wt % |
| (relative washing power) | 18 wt % | 29.3<br>30.7 (100%) | 29.6<br>26.2 (88%) |

The Heubach dust values of the granulate with standard coating or with regard to enzyme dust better than in the case of the granulates prepared by the standard method (see comparison).

The solubility is sharply improved compared to the commercially available standard goods (95% in 8 minutes and 95% in 5 minutes), with 100% after 5 minutes. The washing power does not fall off in a load test at elevated temperature and elevated air humidity after 7 days. In comparison one sees a significant decrease for the base granulate of 12%. In a short-term storage stability test in a traditional washing agent base with bleaching agents (temperature 45° C., relative moisture content 80%), the enzyme granulate with the standard varnish showed a half-life time of 4.2 days. Comparable commercially available granulates in contrast showed half-life times of 1.3 to 1.8 days.

Experiment 2.2. Granulation of highly alkaline protease with soy fine flour.

| Recipe | | |
|---|---|---|
| Vehicle material | Soy fine flour | 7.0 kg |
| Enzyme concentrate = granulation liquid | Highly alkaline protease of Subtilisin 309 type;<br>Aqueous liquid concentrate<br>Activity 1,984,000 DU/g<br>Dry substance content 39.8 wt % | 4.27 kg |

| Conduct of experiment and time | | |
|---|---|---|
| Mixing of vehicle | Without cutter head | 1 min |
| Granulation | With cutter head<br>Spraying-in of concentrate | 13.5 min |
| Postmixing after exposure to dead space | With cutter head | 1 min |
| Drying | Inlet air temperature<br>Product temperature | 80° C.<br>40° C. |

In the case of the moist product there are no particle agglomerates, but only predominantly dense round individual particles result.

| Product qualities | | | |
|---|---|---|---|
| Experiment No. | 2.2a | 2.2b | Comparison |
| Granulate | Base granulate (uncoated) | Base granulate with 23 wt % standard varnish | Base granulate (uncoated) by extrusion method with the same enzyme concentrate |
| Bulk weight | | | |
| Moisture content | about 9 wt % | about 730 g/L | |
| Activity | 1,090,000 DU/g | about 5 wt % | 860,000 DU/g |
| Heubach total dust | 35 mg/20 g | 952,300 DU/g | 99 mg/20 g |
| Heubach enzyme dust | 5.3 mg/20 g | 20 mg/20 g | 80 mg/20 g |
| E-test | 64,000 DU/60 g | 0.80 mg/20 g | |
| Solubility 1 min | 66% | 320 DU/60 g | |
| Solubility 2 min | 83% | 42% | |
| Solubility 3 min | 98% | 75% | |
| Solubility 5 min | 100% | 89% | |
| Acceptable granules 200–1000 μm | 63 wt % | 100%<br>100 wt % | 100 wt % |
| Oversize granules >1000 μm | 15 wt % | 0 wt % | 0 wt % |
| Undersize granules <200 μm | 21.5 wt % | 0 wt % | 0 wt % |
| Washing power: delta reflectance starting | | 26.9 | 29.6 |
| Washing power: delta reflectance, 7 days (relative washing power) | | 27.8 (103%) | 26.2 (88%) |

The Heubach dust values of the granulate with standard coatings are very good. The solubility is outstanding compared to the commercially available standard goods (95% in 8 minutes and 95% in 5 minutes) with 100% after 5 40 minutes.

The washing power does not decrease significantly after 7 days in a load test at elevated temperature and elevated air humidity; in comparison a significant decrease of 12% is seen for the base granulate. In a short-term storage stability test in a customary washing agent base with bleaching agents (temperature 45° C., relative moisture content 85%) the granulate in accordance with the invention with standard varnish shows a half-life of 4.4 days. Comparable commercially available granulates showed, in contrast, only half-life of 1.3 to 1.8 days.

Experiment 2.3. Granulation of highly alkaline protease with soy fine flour and subsequent rounding in a Marumerizer.

| Recipe | | |
|---|---|---|
| Vehicle material | Soy fine flour | 6.3 kg |
| Enzyme concentrate = granulation liquid | Highly alkaline protease of Subtilisin 309 type;<br>Aqueous liquid concentrate<br>Activity 1,984,000 DU/g<br>Dry substance content 39 wt % | 4.11 kg |

| Conduct of experiment and time | | |
|---|---|---|
| Mixing of vehicle | Without cutter head | 1 min |
| Granulation | With cutter head<br>Spraying-in of concentrate | 13 min |
| Postmixing after exposure to dead space | With cutter head<br>Experiment 2.3 a | 1 min |
| Marumerizer | With cutter head<br>Experiment 2.3 b | 0.5 min |
| Marumerizer | Experiment 2.3 c | 1.0 min |
| Marumerizer | Experiment 2.3 d | 3.0 min |
| Marumerizer | Experiment 2.3 e | 5.0 min |
| Drying | Inlet air temperature<br>Product temperature | 80° C.<br>40° C. |

In the case of the moist product from the Lodige mixer it is striking that no particle agglomerates, only predominantly dense rounded individual particles. Small particles sticking to larger particles are rubbed off by the Marumerization process. During drying small particles sticking to the large spherical particles are completely removed, so that individual dense rounded particles result.

| Product qualities | | | | | |
|---|---|---|---|---|---|
| Experiment No. | 2.3a | 2.3b | 2.3c | 2.3d | 2.3e |
| Granulate | uncoated | uncoated | uncoated | uncoated | uncoated |
| Marumerizer time | 0 | 0.5 min | 1.0 min | 3.0 min | 5.0 min |
| Moisture content | about 9% | about 9% | about 9% | about 9% | about 9% |
| Activity, protease | 1,250,000 DU/g | 1,220,000 DU/g | 1,140,000 DU/g | 1,280,000 DU/g | 1,280,000 DU/g |
| Heubach total dust | 41 mg/20 g | 27 mg/20 g | 21 mg/20 g | 9.1 mg/20 g | 22 mg/20 g |
| Heubach enzyme dust | 7.5 mg/20 g | 2.0 mg/20 g | 0.24 mg/20 g | 1.4 mg/20 g | 5.3 mg/20 g |

The particle size distribution of the product is influenced very little by the Marumerization (rounding) and thus corresponds essentially to that of the moist granulate.

Experiment 2.4. Granulation of a thermostable α-amylase with soy fine flour.

| Recipe | | |
|---|---|---|
| Vehicle material | Soy fine flour | 7.0 kg |
| Enzyme concentrate = granulation liquid | Thermostable α-amylase; Aqueous enzyme concentrate: Activity 1,023,000 MWU/g Dry substance content 39.6 wt % | 3.15 kg |
| | Additional water | 0.82 kg |

| Conduct of experiment and time | | |
|---|---|---|
| Mixing of vehicle | Without cutter head | 1 min |
| Granulation | With cutter head | 8.7 min |
| | Spraying-in of concentrate | |
| | Spraying-in of water | 3 × 1 min |
| Postmixing after exposure to dead space | With cutter head | 1 min |
| Drying | Inlet air temperature | 80° C. |
| | Product temperature | 40° C. |

| Product qualities | | |
|---|---|---|
| Experiment No. | 2.4 a | 2.4 b |
| Granulate | Base granulate (uncoated) | 2.4 a with 23 wt % standard coating |
| Bulk weight | | 761 g/L |
| Moisture content | 9 wt % | 8.4 wt % |
| Activity, amylase | 401,000 MWU/g | 369,000 MWU/g |
| Heubach total dust | — | 12 mg/20 g |
| Heubach enzyme dust | 0.11 mg/20 g | 0.14 mg/20 g |
| Solubility 1 min | — | 30% |
| Solubility 2 min | — | 70% |
| Solubility 3 min | — | 90% |
| Solubility 5 min | — | 100% |
| Acceptable granules 200 to 1000 μm | 56 wt % | 100 wt % |

Experiment 2.5. Granulation of an alkaline protease with soy fine flour.

| Recipe | | |
|---|---|---|
| Vehicle material | Soy fine flour | 7.0 kg |
| Enzyme concentrate = granulation liquid | Optimase ® (Solvay Enzymes GmbH & Co. KG, Nienburg, Germany) Aqueous enzyme concentrate: Activity 1,880,000 DU/g Dry substance content 36.4 wt % | 2.76 kg |

| Conduct of experiment and time | | |
|---|---|---|
| Mixing of vehicle | Without cutter head | 1 min |
| Granulation | With cutter head | 8.25 min |
| | Spraying-in of concentrate | |
| Postmixing after exposure to dead space | With cutter head | 1 min |
| Drying | Inlet air temperature | 80° C. |
| | Product temperature | 40° C. |

| Product qualities | | |
|---|---|---|
| Experiment No. | 2.5 a | 2.5 b |
| Granulate | Base granulate (uncoated) | 2.5 a with standard coating |
| Bulk weight | 671 g/L | about 649 g/L |
| Moisture content | 7.2 wt % | — |
| Activity, amylase | 660,000 MWU/g | 840,000 DU/g |
| Heubach total dust | 8.7 mg/20 g | 0.7 mg/20 g |
| Heubach enzyme dust | 0.5 mg/20 g | 0.2 mg/20 g |
| E-test | 50 DU/60 g | 30 DU/60 g |
| Solubility 1 min | — | 30% |
| Solubility 2 min | — | 70% |
| Solubility 3 min | — | 90% |
| Solubility 5 min | — | 100% |
| Acceptable granules 200 to 1000 μm | 56 wt % | 100 wt % |

In the preceding experiments 2.1 through 2.5 the following terms are used:

Heubach enzyme dust. The Heubach dust measurement is used to determine abrasion dust. The dust is generated from the sample by the mechanical action of steel balls in a dust pot. Particles smaller than 50 μm are removed through a controlled dry stream of air and collected on a filter and weighed. In the case of an enzyme-containing sample the enzyme activity collected from the filter can be measured in the customary way and be given in the corresponding enzyme unit with respect to the amount of sample that was used.

E test=elutriation test. A bed of granulate is blown for a set time with a controlled air velocity and the removed dust collected in a wash bottle. The content of dissolved enzyme is then measured with the determination method for the enzyme activity to be investigated and given in the corresponding enzyme unit with respect to the test amount of granulate in g.

DU=The activity of the protease incorporated into the enzyme granulate was determined in Delft units (DU). 1000 DU corresponds to the proteolytic activity that yields an extinction difference (1 cm light path; 275 nm; determination against a blind test sample) of 0.400 for a volume of 1 mL of a 2% enzyme solution (w/w) after decomposition of casein.

MWU=Modified Wohlgemuth unit; the amount of enzyme that decomposes 1 mg soluble starch in 30 minutes to a dextrin of defined size is measured.

The solubility was determined as follows:

In a 400-mL beaker 200 mL of an aqueous solution of a 2% sodium tripolyphosphate solution were stirred at 22° C. with a mechanical vane stirrer at a constant speed of 700 rpm. The solution had a water hardness of 15° German hardness.

While avoiding the formation of lumps 1 g enzyme granulate was added to the stirred solution. Samples were taken after 2, 3 and 5 minutes suctioning them through a suction filter (filter paper: Schleicher and Schull 589). Then in each case the enzyme activity was measured in the filtrates. The protease activity determined in the filtrates (measured in DU) were related to the enzyme activity contained in the enzyme granulates that had been added, where the starting activity in 1 g enzyme granulate corresponded to 100% protease activity. The amylase activity (measured in MWU) was determined analogously.

The storage stability of the enzyme granulates in the presence of washing agent ingredients was determined as follows:

To a perborate-containing and/or percarbonate-containing washing agent formulation that is available commercially for a washing agent manufacturer and that contained 18.4 wt % zeolith [sic]; 7.3 wt % sodium carbonate, 4.8 wt % linear alkylbenzenesulfonate, 3.3 wt % nonionics, 3.3 wt % soap, 0.1 wt % antifoaming agent, 1.5 wt % TAED and 30.85 wt % sodium sulfate, enzyme granulate was mixed in in an amount of 1.0 wt % with respect to the washing agent base formulation. Then this mixture was poured into Schott flasks with a broad neck and stored uncovered in a climate chamber at 45° C. and 80% relative air humidity. At the end of the storage time samples were taken, dissolved in sodium sulfate solution (10 g/L, pH 8.5) and the enzyme activity was determined with this solution in a substantially known way.

What is claimed is:

1. A method of preparing an activity-stable and low-dust enzyme granulate for washing and cleaning applications comprising;

(a) forming an adhesion-free wet granulate including combining: (i) a flour obtained by grinding an organic flour source that has been treated with dry superheated steam to a degree of grinding of 30 to 100% wherein the organic flour source is selected from the group consisting of cereal grains, legumes and fruits of the Malvaceae family; (ii) an enzyme or enzyme mixture; and (iii) a sufficient amount of water in a high-speed mixer to form the adhesion-free wet granulate, wherein 75 to 99.9 parts by weight of the flour and 0.1 to 25 parts by weight of the enzyme or enzyme mixture is used to form the wet granulate and wherein the wet granulate has a moisture content of 15 to 50% and granulate particles in the size range from 0.2 to 2.0 mm; and (b) drying the wet granulate to obtain an activity-stable and low-dust enzyme granulate having moisture content of about 3 to 12%.

2. The method according to claim 1 further comprising, combining up to a maximum total of 20 parts by weight of one or more granulation auxiliary agents or formulation auxiliary agents or mixtures thereof to produce the wet granulate.

3. The activity-stable and low-dust enzyme granulate obtained according to the method of claim 2.

4. The method according to claim 2, wherein 0 to 5 parts by weight auxiliary agents are used to produce the wet granulate.

5. The method according to claim 2, wherein the auxiliary agents are selected from the group consisting of enzyme-compatible suspension agents, binders, fillers, organic solvents, enzyme stabilizers, and reversible enzyme inhibitors.

6. The method according to claim 5, wherein the binders are selected from the group consisting of polyethylene glycols having a molecular weight in the range of 200 to 10,000; polyvinylidene pyrrolidones having a molecular weight in the range of 12,000 to 3,000,000; polyvinyl alcohols or copolymers thereof having a molecular weight in the range of 70,000 to 110,000; degraded soluble starches; and wheat gluten.

7. The method according to claim 1 further comprising, rounding the wet granulate before the drying step.

8. The method according to claim 1 further comprising, separating the dried granulate from undersized particles of less than 0.2 mm and oversized particles of more than 2.0 mm.

9. The method according to claim 8 further comprising, coating the granulate with one or more enzyme-compatible protective layers.

10. The method according to claim 9, wherein the amount of protective layer as a dry substance is 5 to 26 weight % calculated with respect to the uncoated enzyme granulate as 100 weight %.

11. The activity-stable and low-dust enzyme granulate obtained according to the method of claim 9.

12. The method according to claim 1, wherein the particles are in the size range from 0.2 to 1.0 mm.

13. The method according to claim 1, wherein the flour source is treated with dry superheated steam at a temperature range of 100° C. to about 110° C., at a pressure range of approximately normal to 1.2 bar overpressure, and a treatment time of up to about 1 hour.

14. The activity-stable and low-dust enzyme granulate obtained according to the method of claim 13.

15. The activity-stable and low-dust enzyme granulate obtained according to the method of claim 1.

16. A composition comprising the enzyme granulate of claim 15, wherein said composition is a granular or powdered washing or cleaning composition.

17. The method according to claim 1, wherein the enzyme or enzyme mixture is a carbohydrase selected from the group consisting of cellulases, xylanases, pentosanases, pullulanases and amylases.

18. The method according to claim 1, wherein 2 to 25 parts by weight enzyme or enzyme mixture is used to produce the wet granulate.

19. The method according to claim 1, wherein 5 to 21 parts by weight enzyme or enzyme mixture, 79 to 95 parts by weight flour, and a maximum total of 15 parts by weight of auxiliary agents are used to produce the wet granulate.

20. The method according to claim 1, wherein 79 to 95 parts by weight flour is used to produce the wet granulate.

21. The method according to claim 1, wherein the moisture content of the wet granulate is from 15 to 30 weight %.

22. The method according to claim 1, wherein the degree of grinding of said flour is 70 to 100%.

23. The method according to claim 1, wherein the flour is obtained from cereal grains.

24. The method according to claim 1, wherein the enzyme or enzyme mixture is used in the form of a powder.

25. The method according to claim 1, wherein the enzyme or enzyme mixture is used in the form of an aqueous solution.

26. The method according to claim 1, wherein the enzyme or enzyme mixture is a hydrolase, oxidase, reductase or a mixture thereof.

27. The method according to claim 26, wherein the hydrolase is selected from the group consisting of carbohydrases, proteases, lipases, and esterases.

28. The method according to claim 27, wherein the enzyme or enzyme mixture is a protease.

29. The activity-stable and low-dust enzyme granulate obtained according to the method of claim 28.

30. A method of preparing an activity-stable and low-dust enzyme granulate comprising, a) forming an adhesion-free wet granulate including combining:

(i) a flour obtained by grinding an organic flour source that has been treated with dry superheated steam to a degree of grinding of 30 to 100% wherein the organic flour source is selected from the group consisting of legumes and fruits of the Malvaceae family;

(ii) an enzyme or enzyme mixture; and (iii) sufficient amount of water in a high-speed mixer to form the adhesion-free wet granulate wherein 75 to 99.9 parts by weight of the flour and 0.1 to 25 parts by weight of the enzyme or enzyme mixture are used to form the wet granulate and wherein the wet granulate has a moisture content of 15 to 40% and particles in the size range from 0.2 to 2.0 mm; and b) drying the wet granulate to obtain an activity-stable and low-dust enzyme granulate having a moisture content of about 3 to 12%.

31. The method according to claim 30 further comprising, separating the dried granulates from granulate particles having a particle size of less than 0.2 mm and more than 2.0 mm.

32. The activity-stable and low-dust enzyme granulate obtained according to the method of claim 30.

33. A composition comprising the enzyme granulate of claim 32, wherein said composition is a granular or powdered washing or cleaning composition.

34. The method according to claim 30, wherein the degree of grinding is between 50 and 100%.

35. A method of using leguminous flours or flours of the fruit of the family Malvaceae for the preparation of activity-stable enzyme granulates comprising, a) forming an adhesion-free wet granulate including combining:

(i) said flour obtained by grinding an organic flour source that has been treated with dry superheated steam to a degree of grinding of 30 to 100% wherein the organic flour source is derived from a legume or fruits of the Malvaceae family;

(ii) an enzyme or enzyme mixture; and (iii) sufficient amount of water in a high-speed mixer to form the adhesion-free wet granulate, wherein 75 to 99.9 parts by weight of the flour and 0.1 to 25 parts by weight of the enzyme or enzyme mixture is used to form the wet granulate, and wherein the wet granulate has a moisture content of 15 to 50% and particles in the size range from 0.2 to 2.0 mm; and b) drying the wet granulate to obtain an activity-stable and low-dust enzyme granulate having a moisture content of about 3 to 12%.

36. The method according to claim 35, wherein the leguminous flour is obtained from pea or soybean.

37. The enzyme granulate obtained according to the method of claim 35.

38. The method according to claim 35 wherein the flour is in powder form and the enzyme or enzyme mixture is combined with said flour by spraying in the form of an aqueous solution.

* * * * *